US010957507B2

(12) United States Patent
Marode et al.

(10) Patent No.: US 10,957,507 B2
(45) Date of Patent: Mar. 23, 2021

(54) MECHANISM FOR INDIRECT ACCESS TO AN ACTUATOR ON AN APPARATUS DISPOSED WITHIN A HOUSING

(71) Applicant: Appleton Grp LLC, Rosemont, IL (US)

(72) Inventors: Maya G. Marode, Pune (IN); Vaibhav B. Hande, Pune (IN); Abdulkhadar F. Goravankoll, Maharashtra (IN); Rahul L. Kulkami, Maharashtra (IN); Vishal M. Bavale, Maharashtra (IN)

(73) Assignee: Appleton Grp LLC, Rosemont, IL (US)

( * ) Notice: Subject to any disclaimer, the term of this patent is extended or adjusted under 35 U.S.C. 154(b) by 0 days.

(21) Appl. No.: 16/373,467

(22) Filed: Apr. 2, 2019

(65) Prior Publication Data

US 2019/0393010 A1 Dec. 26, 2019

(30) Foreign Application Priority Data

Jun. 27, 2018 (IN) ..... 201821024002

(51) Int. Cl.

| | |
|---|---|
| ***H01H 71/58*** | (2006.01) |
| ***H01H 3/12*** | (2006.01) |
| *H01H 9/22* | (2006.01) |
| *H01H 71/02* | (2006.01) |

(52) U.S. Cl.

CPC ..... *H01H 71/58* (2013.01); *H01H 3/12* (2013.01); *H01H 9/223* (2013.01); *H01H 71/025* (2013.01)

(58) Field of Classification Search

CPC ..... H01H 71/58; H01H 3/12; H01H 71/025; H01H 9/223

USPC ..... 200/330–332, 332.1, 337

See application file for complete search history.

(56) References Cited

U.S. PATENT DOCUMENTS

| | | | | |
|---|---|---|---|---|
| 4,051,340 | A | 9/1977 | Wolski | |
| 4,454,397 | A * | 6/1984 | Kim | H01H 13/04 200/295 |
| 6,020,801 | A | 2/2000 | Passow | |
| 6,396,014 | B1 * | 5/2002 | Minodier | H01H 13/14 200/332.1 |
| 6,448,880 | B2 | 9/2002 | Yu | |

(Continued)

FOREIGN PATENT DOCUMENTS

EP 0 809 270 A2 11/1997

*Primary Examiner* — Edwin A. Leon
*Assistant Examiner* — Lheiren Mae A Caroc
(74) *Attorney, Agent, or Firm* — McDonnell Boehnen Hulbert & Berghoff LLP

(57) ABSTRACT

The present disclosure envisages a mechanism (100) for indirect access to an actuator (210) on an apparatus (200) disposed within a housing (300). The mechanism (100) comprises a bushing (10), a spring-loaded shaft (20), an arm (30), a first stopper (40) and a pedestal (50). The spring-loaded shaft (20) passes through the bushing (10) and is configured to reciprocate through the annular passage (12). An arm (30) is disposed within the housing (300), and is coupled to the shaft (20). The first stopper (40) is received on the shaft (20) operatively below the arm (30). The pedestal (50) is disposed between the arm (30) and the first stopper (40). The pedestal (50) is configured to facilitate abutment of the arm (30) with the actuator (210). The arm (30) is configured to press the actuator (210) when the shaft (20) is linearly displaced.

13 Claims, 5 Drawing Sheets

(56) References Cited

U.S. PATENT DOCUMENTS

| | | | | |
|---|---|---|---|---|
| 6,531,670 | B1 | 3/2003 | Pugh | |
| 8,508,917 | B2 | 8/2013 | Rus et al. | |
| 8,754,341 | B2 * | 6/2014 | Manahan ..... | H01H 13/06<br>200/304 |
| 8,817,455 | B2 | 8/2014 | Baird et al. | |

* cited by examiner

MECHANISM FOR INDIRECT ACCESS TO AN ACTUATOR ON AN APPARATUS DISPOSED WITHIN A HOUSING

RELATED APPLICATIONS

This application claims priority to Indian Patent Application No. 210821024002 entitled "A mechanism for indirect access to an actuator on an apparatus disposed within a housing," filed on Jun. 27, 2018, the contents of which are incorporated by reference herein in their entirety.

FIELD

The present invention relates to the field of actuator mechanisms. More specifically, it relates to indirect actuators.

Definitions

As used in the present disclosure, the following term is generally intended to have the meaning as set forth below, except to the extent that the context in which they are used indicate otherwise.

The expression 'housing' used hereinafter in this specification refers to, but is not limited to, an enclosure which houses at least one electrical or electromechanical component. The housing may be a panel board enclosing one or more electrical or electromechanical circuits.

The expression 'trip' used hereinafter in this specification refers to, but is not limited to, automatic disconnection of a part of an electric circuit as a safety measure.

The expression 'annular' used hereinafter in this specification refers to, but is not limited to, a ring of a circular, rectangular or any other convex shape.

BACKGROUND

Overload relays (OLRs) protects an electrical machine such as an electric motor by sensing the current going to the motor. A thermal overload relay is provided with a small heater element, often bi-metallic element that undergoes deformation such as bending when warmed by electric resistance heating. When a large current passes for a significant duration, heater elements open the relay contacts, thus 'tripping' the relay. Magnetic overload relays operate by sensing the strength of the magnetic field produced by the current flowing to the motor.

OLR is usually mounted inside a sealed plastic housing or a casted housing. To reset a tripped OLR, a cover of the housing needs to be opened and reset button on the OLR needs to be press.

Recently, OLRs came equipped with an automatic reset function. Such an automatic reset function still comes with safety concerns. An unsuspecting operator or a service person servicing such an electrical circuit assuming the circuit is open, may be exposed to extreme hazard if a tripped relay resets automatically. Hence, the automatic reset function may be abandoned. Still, any possibility of opening the housing to manually reset a tripped relay, and consequent safety concerns to operators or damage to crucial components (flame path, and so on) due to improper fitment of housing, must be avoided.

Push buttons accessible outside a housing and connecting with a rod to a reset switch of a relay housed inside the housing are known. However, when an overload relay is replaced, the new relay may not be of the same dimensions. This may require replacing the rod or sometimes the entire connector mechanism.

Therefore, an apparatus for actuating an actuator placed inside a housing from outside the housing is required, which eliminates the above mentioned drawbacks.

Objects

Some of the objects of the present disclosure, which at least one embodiment herein satisfies, are as follows:

An object of the present invention is to provide a mechanism for actuating an actuator placed inside a housing from outside the housing.

Another object of the present invention is to provide a mechanism which adapts to the location of the actuator inside the housing.

Yet another object of the present invention is to provide a mechanism which is reliable.

Still another object of the present invention is to provide a mechanism which is cost-efficient.

Other objects and advantages of the present disclosure will be more apparent from the following description, which is not intended to limit the scope of the present disclosure.

SUMMARY

The present disclosure envisages a mechanism for indirect access to an actuator on an apparatus disposed within a housing. The mechanism comprises a bushing, a spring-loaded shaft, an arm, a first stopper and a pedestal.

The bushing is receivable in an opening configured on the housing. The bushing defines an annular passage therethrough.

The spring-loaded shaft passes through the annular passage defined by the bushing. The shaft defines a head at its end which extends outside of the space enclosed by the housing. The shaft is configured to reciprocate through the annular passage.

The arm is disposed within the housing, and is coupled to the shaft. The arm is configured to be displaced along with the shaft. In an embodiment, a flange projects angularly from the operative end of the arm and abuts the actuator. The actuator is flushed on the surface of a component which the actuator is a part.

The first stopper is received on the shaft operatively below the arm. In an embodiment, an elastic washer is disposed between the pedestal and the first stopper. In another embodiment, a second stopper is received on the shaft operatively above the arm. In an embodiment, the second stopper is a circlip.

The pedestal is disposed between the arm and the first stopper. The pedestal is configured to facilitate abutment of the arm with the actuator.

The arm is configured to actuate the actuator when the shaft is linearly displaced.

In an embodiment, the actuator is a switch. In another embodiment, the actuator is a reset button.

In an embodiment, a gap is defined between an outer surface of the shaft and an inner surface of the bushing, wherein width of the gap ranges from 0.05 mm to 0.15 mm. In another embodiment, the housing is explosion-proof. In yet another embodiment, the gap facilitates cooling of the gases passing through the gap. In still another embodiment, temperature of the gases in the housing after explosion is in the range of 120° C.-250° C.

In an embodiment, the housing is a panel board enclosing a plurality of electrical circuits with a plurality of actuators.

DESCRIPTION OF RELATED DRAWING

LIST OF REFERENCE NUMERALS

100—mechanism
200—apparatus
210—actuator
300—housing
310—cover
320—body
10—bushing
12—annular passage
14—seat
16—threads
20—shaft
22—head
23—collar
24—groove
26—threads
25—compression spring
30—arm
32—flange
40—first stopper
45—elastic washer
50—pedestal
60—second stopper

DETAILED DESCRIPTION

Figure 1:
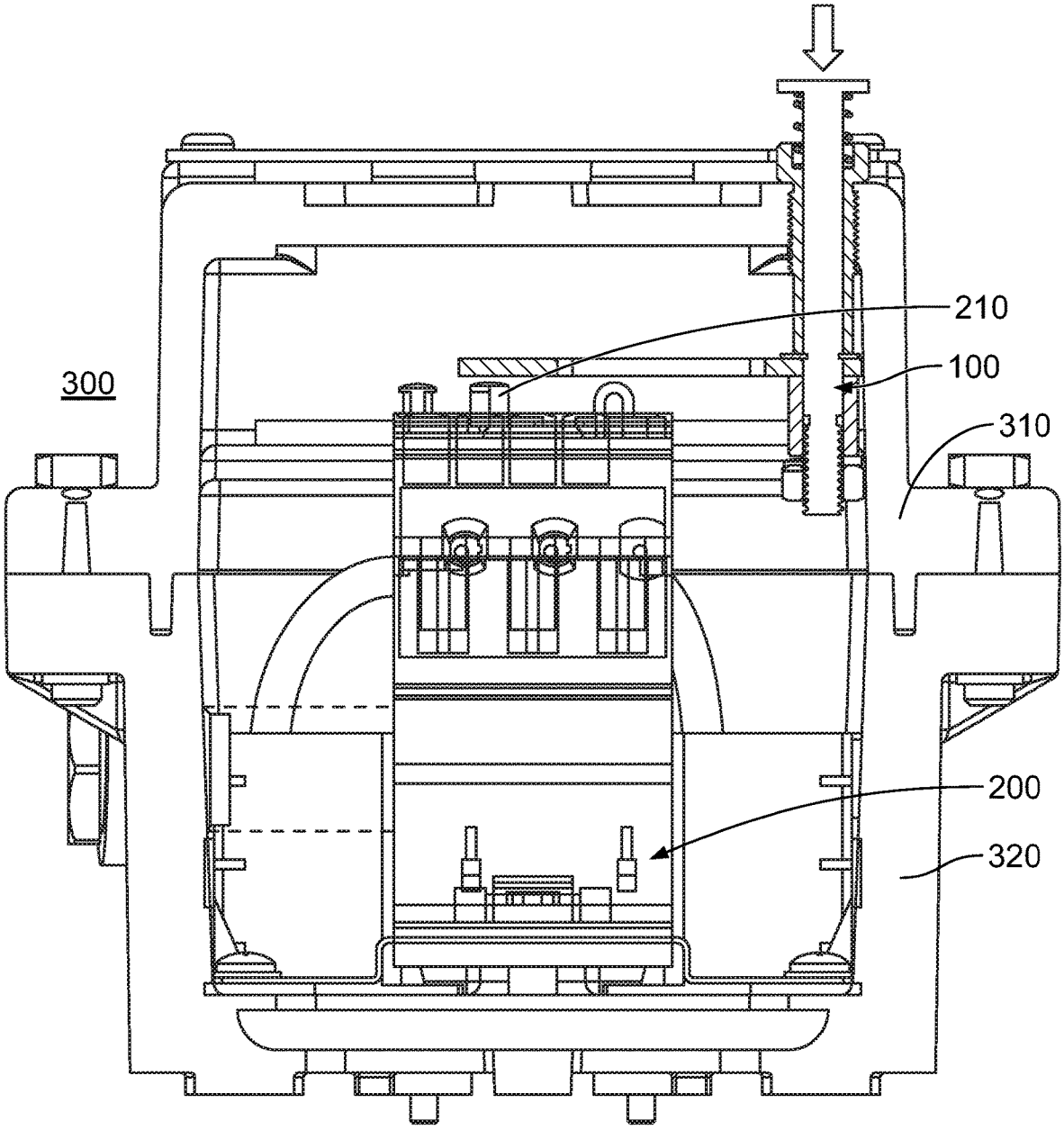
FIG. 1 is a view of a mechanism disposed in a housing in accordance with the present disclosure.

Referring to the accompanying drawing, FIG. 1 is an illustrative embodiment of a mechanism 100 installed in a housing 300 in accordance with the present disclosure. The housing 300 comprises a cover 310 fitted over a body 320 forming an enclosed space. An apparatus 200 is enclosed in this enclosed space of the housing 300. The apparatus comprises an actuator 210 which actuates a mechanical or an electrical or an electromechanical function in the apparatus 200.

Figure 2:
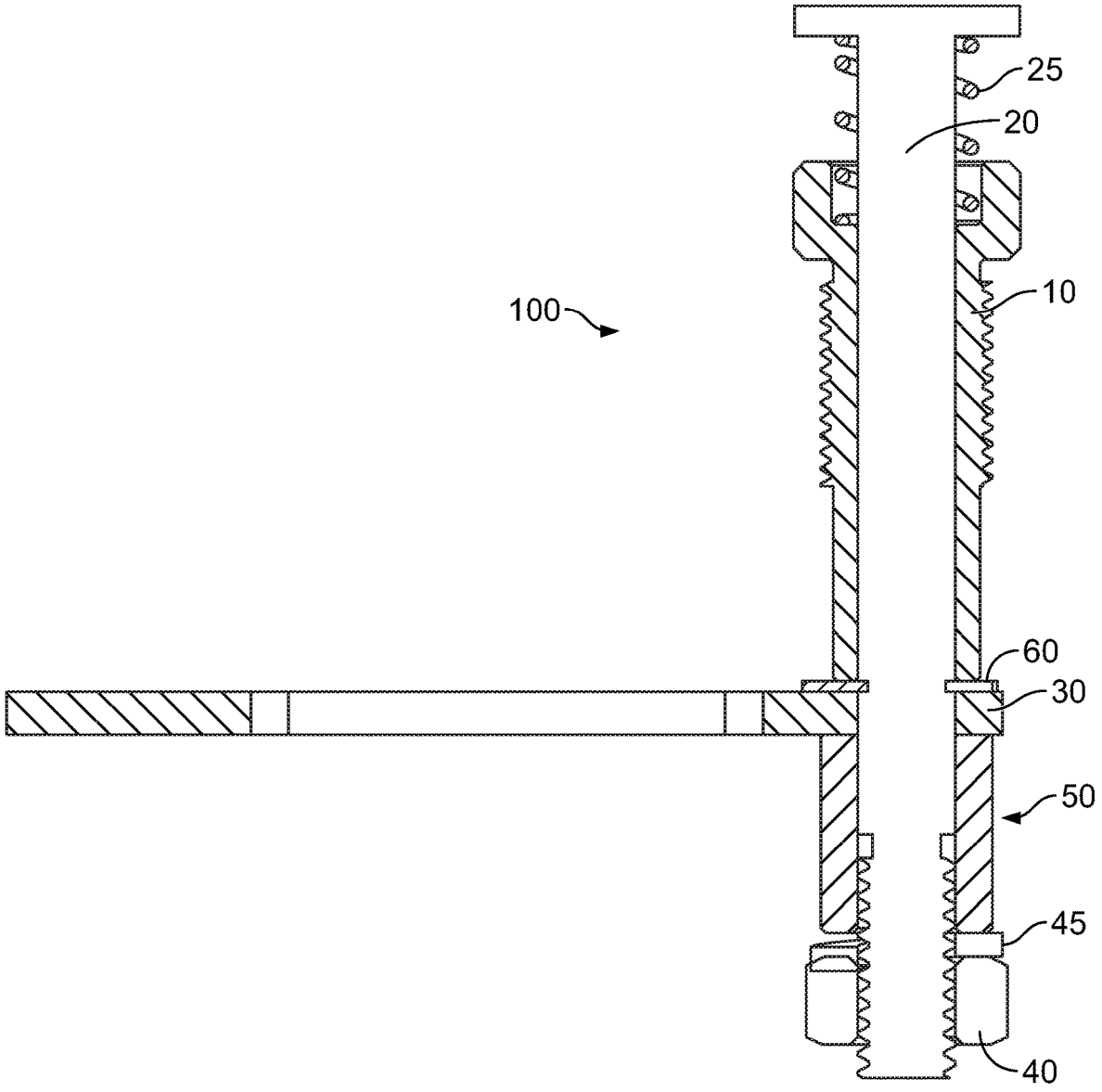
FIG. 2 is a view of a mechanism in accordance with an embodiment of the present disclosure.
Figure 3C:
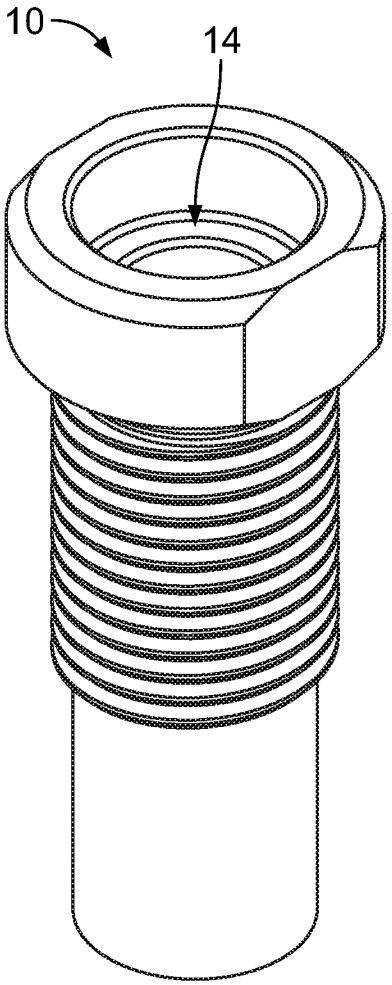
FIG. 3C is an isometric view of a bushing in accordance with an embodiment of the present disclosure.
Figure 3B:
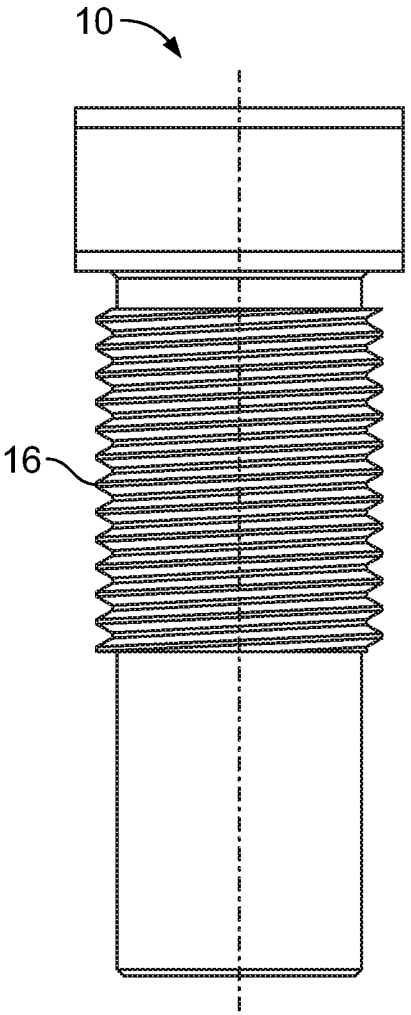
FIG. 3B is a front view of a bushing in accordance with an embodiment of the present disclosure.
Figure 3A:
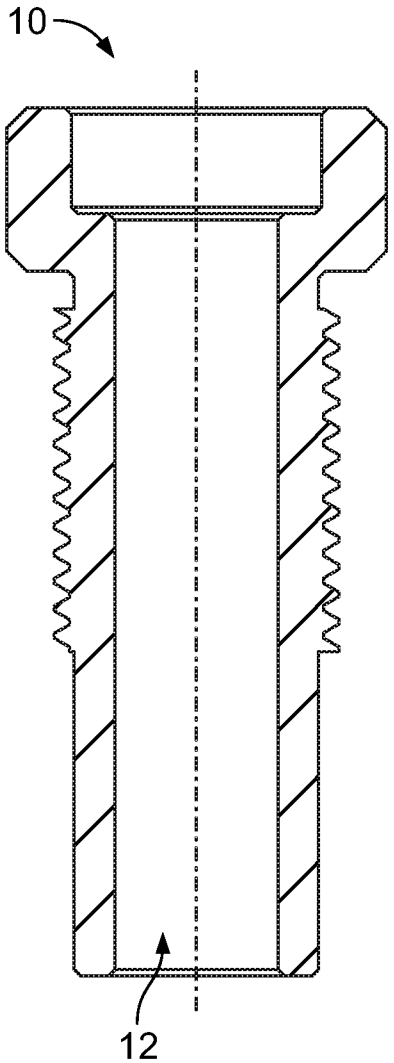
FIG. 3A is a sectional view of a bushing in accordance with an embodiment of the present disclosure.
Figure 4A:
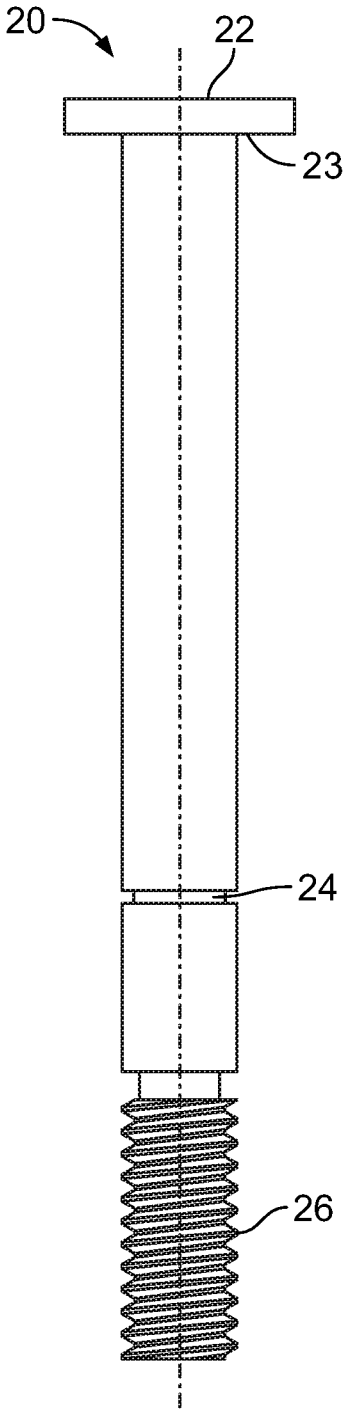
FIG. 4A is a front view of a shaft in accordance with an embodiment of the present disclosure.
Figure 4B:
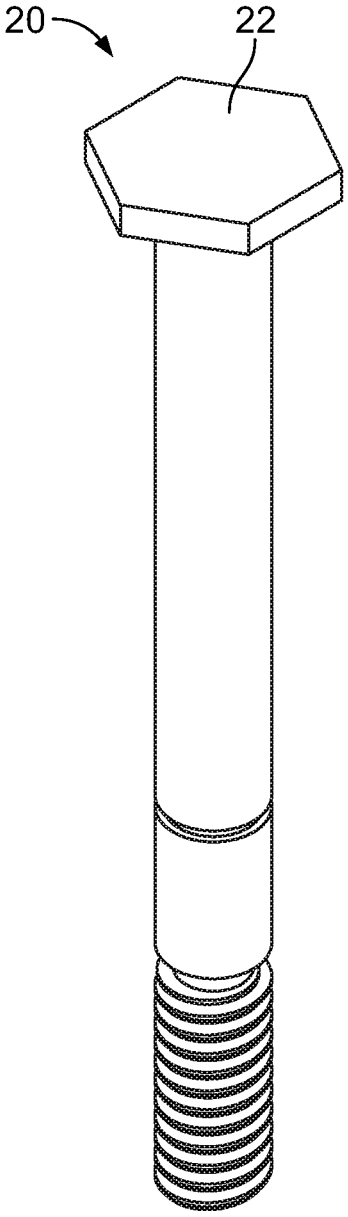
FIG. 4B is an isometric view of a shaft in accordance with an embodiment of the present disclosure.

FIG. 2 illustrates in detail construction of the mechanism 100. The mechanism 100 comprises a bushing 10, a spring-loaded shaft 20, an arm 30, a first stopper 40 and a pedestal 50. The bushing 10 defines an annular passage 12 therethrough, as shown in FIG. 3*a*. The bushing 10 is provided with threads 16 as shown in FIG. 3*b* for securing it in an opening of the housing 300, particularly in the cover 310. Corresponding internal threads are provided in the opening in the cover 310 in which the bushing 10 is secured. The spring-loaded shaft 20 passes through the annular passage 12. The shaft 20 defines a head 22 at its end, as shown in FIGS. 4*a* and 4*b*, which extends outside of the space enclosed by the housing 300. The shaft 20 is configured to reciprocate through the annular passage 12. For facilitating this reciprocating movement, a collar 23, as shown in FIG. 4*a*, is configured around the head 22 defined on the shaft 20 and, as shown in FIG. 3*c*, a seat 14 is configured in the outer end portion of the bushing 10. A compression spring 25 is received in the seat 14. The collar 23 abuts on one end of the compression spring 25. Lubricant for lubricating the motion of the shaft 20 along the passage 12 is poured into the seat before the mechanism 100 is assembled with the cover 310 of the housing 300.

The arm 30 is disposed within the housing 300, and is coupled to the shaft 20. The arm 30 is configured to be displaced along with the shaft 20. A second stopper 60, which is a circlip, facilitates the arm to be coupled with the shaft 20. The circlip snaps inside a groove 24 provided on the shaft 20. FIG. 4*a* shows the groove 24 provided on the shaft 20.

The first stopper 40 is received on the shaft 20 operatively below the arm 30. The first stopper 40 is a nut provided with internal threads and corresponding external threads 26 (shown in FIG. 4*a*) are provided on the shaft 20. The pedestal 50 is disposed between the arm 30 and the first stopper 40. The pedestal 50 is configured to facilitate abutment of the arm 30 with the actuator 210. An elastic washer 45, which is a spring washer, is placed between the first stopper 40 and the pedestal 50 (as shown in FIG. 4*a*). The elastic washer 45 acts as a vibration damper.

The working of the mechanism 100 disposed within a housing 300 is explained hereforth. When the shaft 20 is linearly displaced, the arm 30 is configured to actuates the actuator 210. In an embodiment, the arm 30 is configured to press the actuator 210. A user displaces the shaft by pressing on its head 22, along the direction indicated by the solid arrow in FIG. 1, to push it further inside the housing 300 against the compression spring 25. Hence, the arm 30, which extends orthogonally with respect to the axis of the shaft 20 and abuts on the actuator 210, is displaced downwards by virtue of coupling with the shaft 20 through the second stopper 60. Therefore, the actuator 210 gets actuated and performs its predefined function in the apparatus 200. In an embodiment, the function of the actuator 210 is that of a switch. In another embodiment wherein the apparatus 200 is an overload relay, the function of the actuator 210 is that of a reset button.

Once the pressure on the head 22 is released by the user, the compression spring 25 recoils to push back the shaft 20 outwards through the collar 23. The arm 30 also gets pulled upwards through upward force given by the shaft through the pedestal 50 and the first stopper 40, thereby releasing the actuator 210 from its actuated state.

When the apparatus 200 is replaced by the another apparatus in which the actuator 210 is located at a different location in space, say at a different height from the bottom of the base 320, the position of the arm 30 needs to be reconfigured in order to bring it again in the abutting state with the actuator 210. For this purpose, in an embodiment, the pedestal 50 is replaced with another of a different height which facilitates abutment of the arm 30 with the actuator 210. The pedestal 50 is a spacer. Spacers with different lengths are readily available in the market. In another embodiment, the second stopper 60 remains fixed at its position in the groove 24 made in the shaft 20 and a plurality of pedestals are inserted—one on operative top and another on operative bottom sides of the arm 30, to fix the position of the arm 30 along the length of the shaft 20. To fix the arm 30 further towards bottom of the base 320, the pedestal inserted on its operative top is longer than the pedestal inserted on its operative bottom. In yet another embodiment, the shaft 20 is provided with multiple grooves to fix the second stopper 60 (i.e. circlip) at various heights.

In another embodiment, wherein the apparatus 200 is replaced by the another apparatus in which the actuator 210 is located at a different location in space, say at a different location along the same horizontal plane, the arm 30 is configured as a plate with multiple points available to abut the arm on the actuator 210 located at a different position than before. In an embodiment, the arm 30 is a rectangular plate. In another embodiment, the arm 30 is configured with a plurality of fingers. In yet another embodiment, the arm 30 is configured with a plurality of 'dimples' which abut on actuator 210 available at one of a plurality of locations on a horizontal plane.

Preferably, a corrosion resistant material is used to manufacture the various components of the mechanism 100, including, but not limited to the shaft 20, the bushing 30, the first stopper 40, the pedestal 50 and so on. Stainless steel 316 is one viable alternative. In an embodiment, where mass production of the mechanism 100 is required for an apparatus 200 of fixed dimensions, the pedestal 50 is integrated with the arm 30, by either pressing, riveting, bolting, welding or even casting them together, to save assembly time. In an embodiment, the pedestal 50 is of polymeric material such as polyvinyl chloride.

Figure 5A:
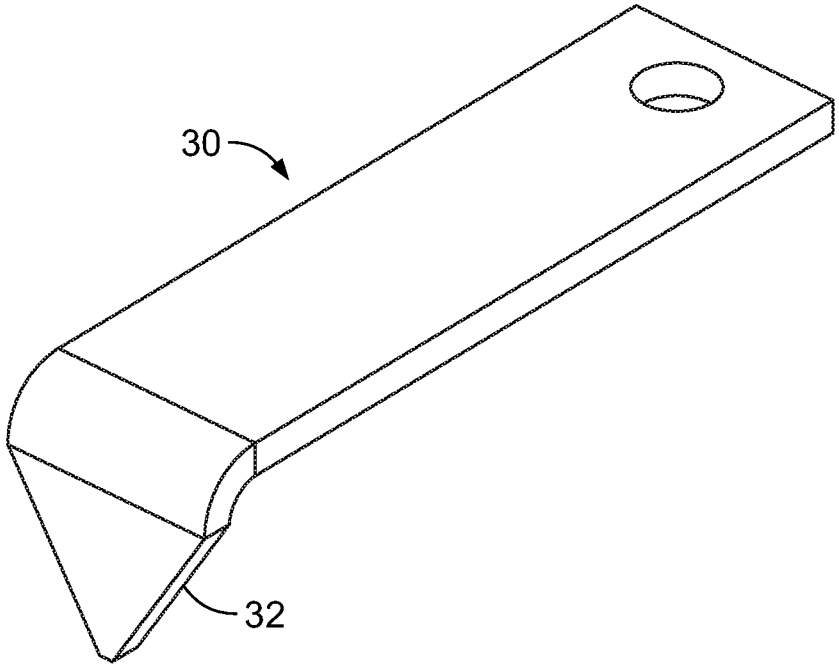
FIG. 5A is an isometric view of an arm in accordance with an embodiment of the present disclosure.
Figure 5B:
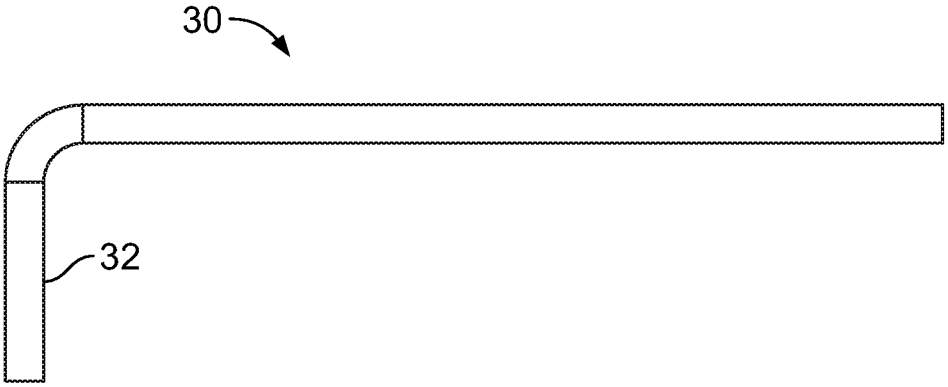
FIG. 5B is a front view an arm in accordance with an embodiment of the present disclosure.

In an embodiment, where the actuator 210 is flushed on a surface of the apparatus 200, a flange 32 is provided on the arm 30 such that the flange 32 projects angularly from the operative end of the arm 30 and abuts the actuator 210. An arm 30 with a flange 32 is illustrated in FIGS. 5*a* and 5*b*.

A gap is defined between an outer surface of the shaft 20 and an inner surface of the bushing 10, wherein width of the gap ranges from 0.05 mm to 0.15 mm. In an embodiment, the housing 300 is required to be explosion-proof, in environments containing explosive gases, for example, in petroleum refineries. Without an explosion-proof housing, the flame of the gases combusted in the enclosed space of the housing would also ignite the gases outside the housing, triggering a catastrophic explosion. The cause of such an internal explosion could be heat generated due to excessive electrical load passing through one of the components of the apparatus 200, wherein the temperature rises beyond flash point of combustible gases which would have permeated inside the housing 300 from outside. The gap defined between an outer surface of the shaft 20 and an inner surface of the bushing 10 facilitates cooling of the gases passing through the gap. The primary mechanism for dissipation of heat and consequent drop in temperature of the flame passing through the gap defined above is Venturi effect taking place as the pressurized burnt gases pass through the extremely narrow gap. Temperature of the gases in the housing 300 after explosion is in the range of 120° C.-250° C., whereas after passing through the gap, they cool down to room temperature. Hence, an explosion in the surrounding of the housing 300 is prevented.

In an embodiment, the housing 300 is a panel board enclosing a plurality of electrical circuits with a plurality of actuators. In another embodiment, one housing enclosing an apparatus is enclosed by another housing. In this embodiment, each housing is equipped with an apparatus identical to mechanism 100, the mechanism provided in the inner housing being actuated by the mechanism provided in the outer housing.

Technical Advancements

The present disclosure described herein above has several technical advantages including, but not limited to, the realization of an apparatus for actuating an actuator placed inside a housing from outside the housing that:

adapts to the location of the actuator inside the housing;
is reliable; and
is cost efficient.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

The use of the expression "at least" or "at least one" suggests the use of one or more elements or ingredients or quantities, as the use may be in the embodiment of the disclosure to achieve one or more of the desired objects or results.

Any discussion of documents, acts, materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

The numerical values mentioned for the various physical parameters, dimensions or quantities are only approximations and it is envisaged that the values higher/lower than the numerical values assigned to the parameters, dimensions or quantities fall within the scope of the disclosure, unless there is a statement in the specification specific to the contrary.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

We claim:

1. A mechanism (100) for indirect access to an actuator (210) on an apparatus (200) disposed within a housing (300), said mechanism (100) comprising:

a bushing (10) receivable in an opening configured on said housing (300), said bushing (10) defining an annular passage (12) therethrough;

a spring-loaded shaft (20) passing though said annular passage (12) defined by said bushing (10), said shaft (20) defining a head (22) at its end which extends outside of a space enclosed by said housing (300), wherein said shaft (20) is configured to reciprocate through said annular passage (12);

an arm (30) disposed within said housing (300), and coupled to said shaft (20), wherein said arm (30) extends outwardly from said shaft (20) and is configured to be displaced along with said shaft (20);

a first stopper (40) received on said shaft (20) operatively below said arm (30) and configured to be displaced along with said shaft (20); and a pedestal (50) positioned around said shaft (20) and disposed between said arm (30) and said first stopper (40), wherein said pedestal (50) is configured to facilitate abutment of said arm (30) with said actuator (210), and wherein said pedestal (50) is configured to be displaced along with said shaft (20);

wherein, said arm (30) is configured to actuate said actuator (210) when said shaft (20) is linearly displaced.

2. The mechanism (100) as claimed in claim 1, wherein a collar (23) is configured around said head (22) defined on said shaft (20).

3. The mechanism (100) as claimed in claim 1, wherein an elastic washer (45) is disposed between said pedestal (50) and said first stopper (40).

4. The mechanism (100) as claimed in claim 1, wherein a second stopper (60) is received on said shaft (20) operatively above said arm (30).

5. The mechanism (100) as claimed in claim 4, wherein said second stopper (60) is a circlip.

6. The mechanism (100) as claimed in claim 1, wherein said actuator (210) is a switch.

7. The mechanism (100) as claimed in claim 1, wherein said actuator (210) is a reset button.

8. The mechanism (100) as claimed in claim 1, wherein a flange (32) projects angularly from an operative end of said arm (30) and abuts said actuator (210), and said actuator (210) is flushed on a surface of said apparatus (200).

9. The mechanism (100) as claimed in claim 8, wherein said housing (300) is explosion-proof.

10. The mechanism (100) as claimed in claim 1, wherein a gap is defined between an outer surface of said shaft (20) and an inner surface of said bushing (10), wherein a width of said gap ranges from 0.05 mm to 0.15 mm.

11. The mechanism (100) as claimed in claim 10, wherein said gap facilitates cooling of any gases passing through said gap.

12. The mechanism (100) as claimed in claim 10, wherein a temperature of any gases in said housing (300) after explosion is in a range of 120° C.-250° C.

13. The mechanism (100) as claimed in claim 1, wherein said housing (300) is a panel board enclosing a plurality of electrical circuits with a plurality of actuators.

* * * * *